US006209870B1

(12) United States Patent
Shea et al.

(10) Patent No.: US 6,209,870 B1
(45) Date of Patent: Apr. 3, 2001

(54) COMBINATION GOLF DICE GAME AND METHOD FOR PLAYING

(76) Inventors: Patrick J Shea, 17451 High St., Los Gatos, CA (US) 95030; Zane A Tabari, 1840-2 Cherokee Dr., Salinas, CA (US) 93906

( * ) Notice: Subject to any disclaimer, the term of this patent is extended or adjusted under 35 U.S.C. 154(b) by 0 days.

(21) Appl. No.: 09/315,117

(22) Filed: May 19, 1999

(51) Int. Cl.[7] ..... A63F 9/04

(52) U.S. Cl. ..... 273/146; 273/138.1; 273/245; 273/259

(58) Field of Search ..... 273/146, 138.1, 273/143 A, 243, 268, 288, 245, 236, 139, 244, 259

(56) References Cited

U.S. PATENT DOCUMENTS

| | | | | |
|---|---|---|---|---|
| 3,658,339 | | 4/1972 | Boileau | 273/134 |
| 3,722,885 | * | 3/1973 | Leaf . | |
| 3,826,498 | | 7/1974 | Monek | 273/134 |
| 3,857,568 | | 12/1974 | Yoder | 273/134 |
| 3,910,581 | | 10/1975 | Nicholson | 273/134 |
| 3,929,337 | * | 12/1975 | Hayes . | |
| 3,944,229 | | 3/1976 | Feeney | 273/134 |
| 4,277,065 | | 7/1981 | White | 273/245 |
| 4,465,279 | * | 8/1984 | Larson . | |
| 5,133,559 | * | 7/1992 | Page . | |
| 5,145,175 | * | 9/1992 | Gathman . | |
| 5,169,148 | * | 12/1992 | Wheeler . | |
| 5,234,218 | | 8/1993 | LaRocca | 273/245 |
| 5,413,349 | | 5/1995 | Ganther | 273/245 |
| 5,425,537 | * | 6/1995 | Vogelsang . | |
| 5,722,659 | | 3/1998 | Gluth | 273/245 |
| 5,839,725 | | 11/1998 | Conway | 273/244 |

* cited by examiner

*Primary Examiner*—Benjamin H. Layno
*Assistant Examiner*—Vishu Mendiratta
(74) *Attorney, Agent, or Firm*—Intellectual Property Law Group; Oho O. Lee; Takashi Hashimoto

(57) ABSTRACT

A combination golf dice game is disclosed in which the scoring on a golf course with respect to each hole is simulated by rolling a die bearing different stroke numbers and a par value. After playing all the holes, the player with the best overall score of all the dice wins the game.

14 Claims, 1 Drawing Sheet

NUMERICAL LAYOUT OF TWELVE-SIDED DICE

COMBINATION A

COMBINATION B

SET 1

BLUE COLOR

PAR VALUE: 5

COMBINATION A

COMBINATION B

SET 2

RED COLOR

PAR VALUE: 3

COMBINATION A

SET 3

WHITE COLOR

PAR VALUE: 4

FIGURE 1. NUMERICAL LAYOUT OF TWELVE-SIDED DICE
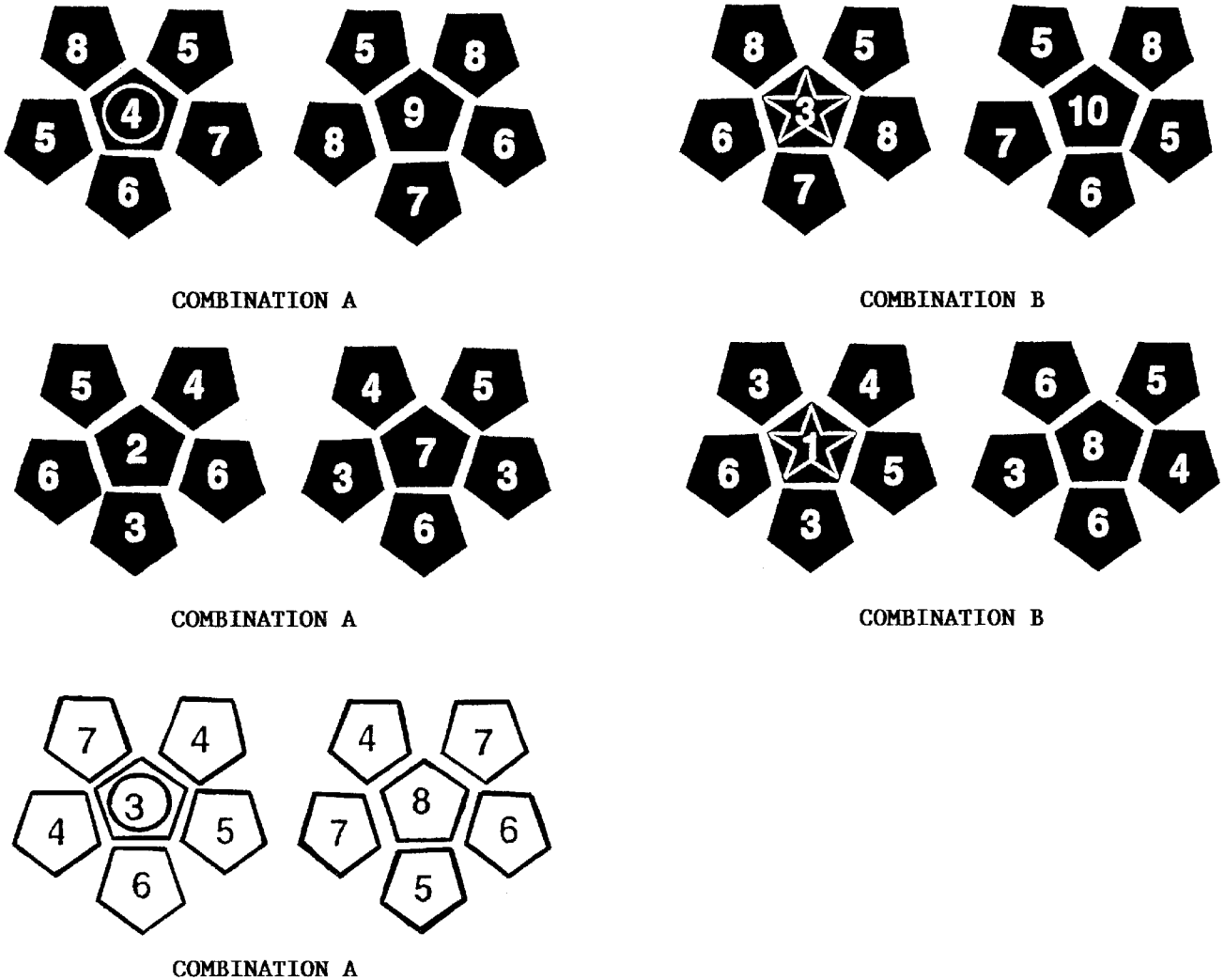

COMBINATION GOLF DICE GAME AND METHOD FOR PLAYING

BACKGROUND

This invention relates generally to a golf game, and specifically relates to a golf game in which a player rolls a number of dice and choose at least one dice to obtain a score for a hole. Each die is designed to reflect the par value of a hole such that the scoring of the dice game is based on the designation of par value of a hole.

Many games devised to simulate the experience of playing golf have been made. One common feature in these games is the use of game boards to simulate a golf course. Consequently a player can direct the movement of a game token on the board to simulate the movement and locations of a golf ball. The board includes various golf course hazards so that the movement of the game token is challenged by the complexity of the golf course layout. Such golf board games can be found in U.S. Pat. Nos. 5,722,659, 5,413,349, 3,944,229 and 3,658,339.

The inclusion of boards and various other components in golf games increases the manufacturing costs and makes it inconvenient for players to carry. In addition, to direct the movement of a token golf ball, the board games prescribe complex rules with regard to distance and direction of the movement. Furthermore, the board golf games establish various rules to simulate golf course hazards. The complexity of the game design makes it difficult to learn and master.

Despite the efforts of these golf board games in simulating real golf course conditions, the key of a good golf game remains the stimulation of excitement resulting from uncertainty, pressure, anxiety, and anticipation. The competitive nature of a golf game determines that the ultimate goal of playing golf is to obtain a good score.

SUMMARY

Accordingly, there is a need for a game that teaches and simulates the competitive nature of a golf game. The present invention meets these needs by providing a simplified combination dice golf game in which the result of playing a hole is obtained by rolling a combination of dice and selecting a die with the best score.

The apparatus of the game is a number of dice, each die representing a hole with a par value. The dice are divided into sets. The dice within each set have the same par value and are visually distinguishable from the dice in the other sets. Each die has a number of sides bearing symbols indicating a stroke number.

In a preferred embodiment, there are either nine or eighteen dice to represent either a nine-hole or an eighteen-hole game.

In another preferred embodiment, each die has a par value of three, four or five.

In yet another preferred embodiment, the dice in different sets are distinguishable by color or size.

In another embodiment, the stroke number on the sides of the dice consists of one eagle, three pars, two bogeys, two double bogeys, three triple bogeys and one quadruple bogey. In yet another preferred embodiment, the eagle and the quadruple bogey are replaced with a birdie and a quintuple bogey.

In playing the combination golf dice game, a player rolls all the dice and pick one with a best score, to simulate the play of a golf hole. The player repeats the rolling and selection until the last die in the round is chosen. The player with the best overall score wins the game.

In one preferred embodiment, the player has a choice of removing any number of dice after one roll.

In another preferred embodiment, the player prior to the rolling can choose a stroke number appearing on the side facing the surface for scoring.

In yet another preferred embodiment, the player receives a penalty for rolling dice out of the boundary. The penalty is not imposed if the player catches the die before it hits the ground.

Therefore the present invention satisfies the long felt need of having a golf game that is simple to carry, easy to learn and less costly to make. By using dice with different par values to represent golf holes, the combination golf dice game closely simulates the specific scoring system of a golf game.

DRAWINGS

These and other features, aspects, and advantages of the present invention will become better understood with regard to the following description, appended claims, and accompanying drawings where:

FIG. 1 is the layout of the sides of the dice in a combination golf dice game.

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a combination dice golf game that simulates the golf game with the rolling of a combination of dice. The game has a pre-determined number of holes to be played in one round, preferably either nine or eighteen holes. The total number of dice is equal to the pre-determined number of holes, so that for a nine-hole game, for example, the dice golf game has nine dice.

Each die is assigned a par value, corresponding to the par value of a hole. Dice of the same par value are grouped into a set. In a preferred embodiment, each die of the dice golf game has a par value of three, four or five, as in a regular golf game. The dice are accordingly divided into three sets. It is preferable that the total par value of the nine hole game is equal to thirty-six. In one preferred embodiment, there are two dice for par three holes, five dice for par four holes and two dice for par five holes.

The dice in one set having the same par value are visually distinguishable from dice in other sets, so that when all the dice are rolled, the par value of a particular die is immediately apparent. Knowing the par value of a die is important because each hole on a golf course has a designated par value. For example, a four-stroke play is a good play for a par five hole. However, it is not as good if the hole has a par value of three. The par designation minimizes the variation of difficulties associated with different holes, and is a key concept for beginners to understand.

The designation of par value to each die incorporates this important concept. Because of the number of dice used in the game, it is preferred to make the par value of a die immediately apparent to a player after the player rolls all the dice. In a preferred embodiment, the dice within a set is distinguishable from the dice in another set by colors. In another preferred embodiment, the sets are distinguishable by the size of the dice.

Each die has a number of sides that bear symbols, indicating the number of strokes. In a preferred embodiment, the symbols are numerals, representing numbers of the strokes. In another preferred embodiment, the numerals are highlighted by additional symbols, wherein one under par is highlighted by a circle, and two under par is highlighted by a star.

The symbols on the sides of a die encompass a distribution of various possible stroke numbers for playing a hole. The scores are commonly referred to in a golf game as follows:

| | |
|---|---|
| two under par | eagle |
| one under par | birdie |
| par | par |
| one over par | bogey |
| two over par | double bogey |
| three over par | triple bogey |
| four over par | quadruple bogey |
| five over par | quintuple bogey |

To increase the representation of different scores, it is preferred to have a die with more sides than a conventional six-sided die. In one preferred embodiment, the number of sides of a die is twelve.

Practically, both outstanding plays such as an eagle and poor plays such as quintuple bogey are less common. Most scores will be around the average play, such as one or two above par. Because the sides of a die are substantially similar, the odds of getting one side is practically the same as any other sides. To vary the odds of getting a particular score, more common scores are represented on more sides of a die. A less likely play only appears on one side of a die. Therefore, a play that appear three times on a die will be three times more likely to be hit than a play appearing only once. Because of the limitation of the number of sides a die can practically have, it is preferred to put the most common plays of a hole on three sides of a die, so that the odd of getting such a play is three times of a play appearing only once. To give adequate representation of various plays, a twelve-sided die is preferred.

Following the descriptions above, a preferred combination of dice are illustrated in FIG. 1. There are nine dice representing a nine-hole game. Each die has an assigned par value of three, four or five. The dice are divided into three sets according to their par values. The sets are distinguished by different colors. The par three set contains two dice and has a red color. The par four set contains five dice and has a white color. The par five set contains two dice and has a blue color. The par of the nine dice totals thirty-six.

Each die has twelve sides bearing numerals, one numeral on a side. The twelve numerals on one die consists of one of the following two combinations, A or B:

| | Combination | |
|---|---|---|
| | A | B |
| eagle | | 1 |
| birdie | 1 | |

-continued

| | Combination | |
|---|---|---|
| | A | B |
| par | 3 | 3 |
| bogey | 2 | 2 |
| double bogey | 2 | 2 |
| triple bogey | 3 | 3 |
| quadruple bogey | 1 | |
| quintuple bogey | | 1 |
| total: | 12 | 12 |

For the two dice in the par three set, the numerals on the first die consists of combination A, and the numerals on the second die consists of combination B, as indicated in FIG. 1. Similarly, the numerals on one die of the par five set consists of combination A and the other one consists of combination B. Five par four dice are all identical and numerals on each par four die consists of combination A.

In a preferred embodiment, the twelve numerals are arranged on the sides according to the following rules: an eagle is always on the opposite side of a quintuple bogey; a birdie opposite to a quadruple bogey; a par opposite to a triple bogey and a bogey opposite to a double bogey. This arrangement allows opposite sides to have reversed odds, such that a better score has a comparably worse score on the opposite side.

The combination golf dice game apparatus as described above is played on a substantially flat surface with a designated boundary. A player rolls all the dice and then selects a die with a best score. Once the player chooses and removes a die with a certain par value, a game hole with a corresponding par value is regarded as having been played. The player will then roll the rest of the dice and repeat the selection process, to simulate the play of the rest of the holes. The game for a round is completed when the player removes the last die. The result of the play is determined by the overall scores of all the selected dice. The player with the best overall score wins the game.

Normally a player can only select one die each time after the dice are rolled. To encourage players to take their chances, a player can choose to take one or more than one dice after one roll. If the player decides to choose more than one die after one roll, the player is having a "run." When a "run" happens, the player will have less dice to roll than had only one die been chosen and thus will skip plays of the extra dice the player has chosen.

In another variation of the playing method, the player can reverse the odds of playing. Normally, the stroke number of a die is based on what appears on the top side facing up after the die stops rolling. To change the odds, the player can express clearly to other players, before the dice are rolled, the desire that the stroke number on the bottom side will count, instead of the number on the top side. In one preferred embodiment, a player called out loud "bottoms" before the rolling, so that only the bottom side of the die facing the surface will be counted.

The odds can be completely reversed when a die is designed in such that the opposite sides bearing stroke numbers of opposite scores. For example, as illustrated in FIG. 1, a par four die has on one side a numeral 3 representing a score of a birdie, and has on the opposite side a numeral 8 representing a score of a quadruple bogey. In such a case, the odds of getting the quadruple bogey, the worst score on the die, is completely reversed to the odds of a birdie, the best score on the die, when a "bottoms" is timely called.

In another variation of the playing method, the player receives a penalty for rolling a die out of the designated boundary of the playing surface. However the penalty is not imposed if the player catches the die before its hits the ground.

What is claimed is:

1. A combination golf dice game comprising a number of dice, wherein each die represents a golf hole of a par value, wherein the dice with the same par value are grouped into a set, each set being visually distinguishable from the other sets, wherein each die has a plurality of sides, each side bearing a symbol indicating a stroke number, the symbol on the sides of a die comprising at least a birdie having an additional symbol signifying one less than a par, a par, and a bogie signifying one more than a par;

such that when a player rolls the dice, the player can choose at least one die with the stroke number that shows a best score as compared to the par value of the chosen die.

2. A combination golf dice game of claim 1 in which there are nine dice, representing a nine-hole golf game.

3. A combination golf dice game of claim 1 in which there are eighteen dice, representing an eighteen-hole golf game.

4. A combination golf dice game of claim 1 in which the par value comprising three, four and five.

5. A combination golf dice game of claim 1 in which the dice in each set are visually distinguishable by bearing different colors, such that when the dice are rolled, the par value of a die is immediately apparent.

6. A combination golf dice game of claim 1 in which the dice in each set are visually distinguishable by being made of different size, such that when the dice are rolled, the par value of a die is immediately apparent.

7. A combination golf dice game of claim 1 in which the plurality of sides of the die is twelve.

8. A combination golf dice game of claim 7 in which the stroke number on the sides of the die consisting of one eagle, three pars, two bogeys, two double bogeys, three triple bogeys and one quadruple bogey.

9. A combination golf dice game of claim 7 in which the stroke number on the sides of the die consisting of one birdie, three pars, two bogeys, two double bogeys, three triple bogeys and one quintuple bogey.

10. The combination golf dice game of claim 1 in which the stroke number of the sides of a die comprising at least a. an eagle, with a number being equal to the par value minus two;

b. a number being the par value;

c. a bogey, with a number being equal to the par value plus one.

11. A combination golf dice game of claim 10 wherein the side bearing the eagle is highlighted by a symbol of a star.

12. The combination golf dice game of claim 1 in which the stroke number of the sides of a die comprising at least a. birdie, with a number being equal to the par value minus one;

b. a number being the par value; and c. a bogey, with a number being equal to the par value plus one.

13. A combination golf dice game of claim 12 wherein the side bearing the birdie is highlighted by a symbol of a circle.

14. A combination golf dice game comprising nine dice, a) wherein a first die is red and has an assigned par value of three, the body of the first die comprising:

i. a first side, bearing a numeral 2;

ii. a second side being opposite to the first side, bearing a numeral 7;

iii. a third side, bearing a numeral 3;

iv. a fourth side being opposite to the third side, bearing a numeral 6;

v. a fifth side, bearing a numeral 3;

vi. a sixth side being opposite to the fifth side, bearing a numeral 6;

vii. a seventh side, bearing a numeral 3;

viii. an eighth side being opposite to the seventh side, bearing a numeral 6;

ix. a ninth side, bearing a numeral 4;

x. a tenth side being opposite to the ninth side, bearing a numeral 5;

xi. an eleventh side, bearing a numeral 4;

xii. a twelfth side being opposite to the eleventh side, bearing a numeral 5;

b) wherein a second die is red and has an assigned par value of three, the body of the second die comprising:

i. a first side, bearing a numeral 1;

ii. a second side being opposite to the first side, bearing a numeral 8;

iii. a third side, bearing a numeral 3;

iv. a fourth side being opposite to the third side, bearing a numeral 6;

v. a fifth side, bearing a numeral 3;

vi. a sixth side being opposite to the fifth side, bearing a numeral 6;

vii. a seventh side, bearing a numeral 3;

viii. an eighth side being opposite to the seventh side, bearing a numeral 6;

ix. a ninth side, bearing a numeral 4;

x. a tenth side being opposite to the ninth side, bearing a numeral 5;

xi. an eleventh side, bearing a numeral 4;

xii. a twelfth side being opposite to the eleventh side, bearing a numeral 5;

c) wherein a third die is blue and has an assigned par value of five, the body of the third die comprising:

i. a first side, bearing a numeral 4;

ii. a second side being opposite to the first side, bearing a numeral 9;

iii. a third side, bearing a numeral 5;

iv. a fourth side being opposite to the third side, bearing a numeral 8;

v. a fifth side, bearing a numeral 5;

vi. a sixth side being opposite to the fifth side, bearing a numeral 8;

vii. a seventh side, bearing a numeral 5;

viii. an eighth side being opposite to the seventh side, bearing a numeral 8;

ix. a ninth side, bearing a numeral 6;

x. a tenth side being opposite to the ninth side, bearing a numeral 7;

xi. an eleventh side, bearing a numeral 6;

xii. a twelfth side being opposite to the eleventh side, bearing a numeral 7;

d) wherein a fourth die is blue and has an assigned par value of five, the body of the fourth die comprising:

i. a first side, bearing a numeral 3;

ii. a second side being opposite to the first side, bearing a numeral 10;

iii. a third side, bearing a numeral 5;

iv. a fourth side being opposite to the third side, bearing a numeral 8;

v. a fifth side, bearing a numeral 5;

vi. a sixth side being opposite to the fifth side, bearing a numeral 8;

vii. a seventh side, bearing a numeral 5;

viii. an eighth side being opposite to the seventh side, bearing a numeral 8;

ix. a ninth side, bearing a numeral 6;

x. a tenth side being opposite to the ninth side, bearing a numeral 7;

xi. an eleventh side, bearing a numeral 6;

xii. a twelfth side being opposite to the eleventh side, bearing a numeral 7;

e) wherein a fifth, sixth, seventh, eighth and ninth dice are white and each has an assigned par value of four, the body of each of the white dice comprising:

i. a first side, bearing a numeral 3;

ii. a second side being opposite to the first side, bearing a numeral 8;

iii. a third side, bearing a numeral 4;

iv. a fourth side being opposite to the third side, bearing a numeral 7;

v. a fifth side, bearing a numeral 4;

vi. a sixth side being opposite to the fifth side, bearing a numeral 7;

vii. a seventh side, bearing a numeral 4;

viii. an eighth side being opposite to the seventh side, bearing a numeral 7;

ix. a ninth side, bearing a numeral 5;

x. a tenth side being opposite to the ninth side, bearing a numeral 6;

xi. an eleventh side, bearing a numeral 5;

xii. a twelfth side being opposite to the eleventh side, bearing a numeral 6.

* * * * *

UNITED STATES PATENT AND TRADEMARK OFFICE

CERTIFICATE OF CORRECTION

PATENT NO. : 6,209,870 B1
DATED : April 3, 2001
INVENTOR(S) : Shea et al.

It is certified that error appears in the above-identified patent and that said Letters Patent is hereby corrected as shown below:

Title page,
Item [74], should read as follows:
[74], Attorney, Agent, or Firm-Intellectual Property Law Group; Otto O. Lee, Takashi Hashimoto.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*